United States Patent [19]

McCurdy

[11] Patent Number: 4,489,666

[45] Date of Patent: Dec. 25, 1984

[54] MOVABLE AIR SUPPLY FOR COMBUSTION APPARATUS

[76] Inventor: Edwin L. McCurdy, 1074 S. Dahlia #G-202, Denver, Colo. 80222

[21] Appl. No.: 590,144

[22] Filed: Mar. 16, 1984

[51] Int. Cl.[3] ..... F23H 3/00

[52] U.S. Cl. ..... 110/297; 110/299

[58] Field of Search ..... 110/297, 299, 300, 309, 110/310, 311, 312, 314; 239/437, 438, 439

[56] References Cited

U.S. PATENT DOCUMENTS

| | | | |
|---|---|---|---|
| 133,937 | 12/1872 | Hatch | 266/140 |
| 205,431 | 6/1878 | Snider | 110/313 |
| 958,971 | 5/1910 | Palmer | 110/298 |
| 1,952,227 | 3/1934 | Adams | 110/251 |
| 2,288,012 | 6/1942 | Mongan | 239/437 |
| 4,167,146 | 9/1979 | Wirth | 110/251 |
| 4,241,671 | 12/1980 | Joyner et al. | 110/188 |

*Primary Examiner*—Edward G. Favors

[57] ABSTRACT

The location of an air supply in a combustion apparatus is made adjustable by changing the point of intersection of a slot in a movable surface with a slot in a fixed surface. In the preferred embodiment, the fixed and movable surfaces are of tubular construction. Variations include a second movable surface for the purpose of extending the range of adjustment, and the use of discrete holes rather than slots in the fixed and movable surfaces.

2 Claims, 7 Drawing Figures

MOVABLE AIR SUPPLY FOR COMBUSTION APPARATUS

BACKGROUND OF THE INVENTION

1. Field of the Invention

This invention provides a means of modifying the flow of air into a combustion apparatus. Specifically, it provides a means of modifying the location of the airflow within the apparatus.

2. Description of the Prior Art

Past practice has most commonly been to fix the location of an air supply within a combustion apparatus, and to provide a means of modifying the rate of airflow into the apparatus. This practice is especially well suited for use when the type of fuel and depth of fuel bed remain constant or nearly so.

One typical air supply arrangement furnishes primary combustion air at a certain depth below the top of the fuel bed, usually through a grate. Secondary air is supplied to the fire at a certain height above the top of the fuel bed. The depth of the primary air supply and the height of the secondary air supply are established so as to provide maximum efficiency at the design rate of burning. The fuel bed depth is maintained constant by a continuous fuel-loading mechanism.

When the type of fuel and/or depth of fuel bed are subject to change, a means of modifying the location of the airflow within the combustion apparatus is sometimes desirable. Several prior inventions provide such means; however, the present invention offers an original mechanism which is especially well-suited for certain uses, as should become apparent from the description below.

SUMMARY OF THE INVENTION

In its simplest form, the invention consists of one fixed surface containing a slot and one movable surface containing another slot. Air is supplied to a combustion apparatus through the intersection of the two slots. The location of this intersection is changed by movement of the movable surface.

When applied to the typical air supply arrangement described above, this mechanism allows the depth of the primary air supply below the top of the fuel bed to be varied so as to provide best efficiency for different fuels and firing rates. A duplicate mechanism allows the height of the secondary air supply above the top of the fuel bed to be varied for the same reason. Furthermore, the depth of the fuel bed may be allowed to change while maintaining the depth of the primary air supply and the height of the secondary air supply constant with respect to the top of the fuel bed. Thus, fuel may be batch-loaded into a combustion apparatus so that the top of the fuel bed is near the top of the apparatus, and may then be burned without replenishment so that the top of the fuel bed is continuously lowered; during this burning process, the depth of the primary air supply and the height of the secondary air supply may be maintained constant with respect to the top of the fuel bed. In this manner, fuel may be burned in a batch-loaded combustion apparatus with the same efficiency that is obtained in a continuously-loaded apparatus. Much of the fuel-handling equipment normally associated with a combustion apparatus may be eliminated, resulting in a smaller and simpler installation.

DESCRIPTION OF THE PREFERRED EMBODIMENT

In the preferred embodiment, the fixed and movable surfaces are of tubular construction.

Figure 2:
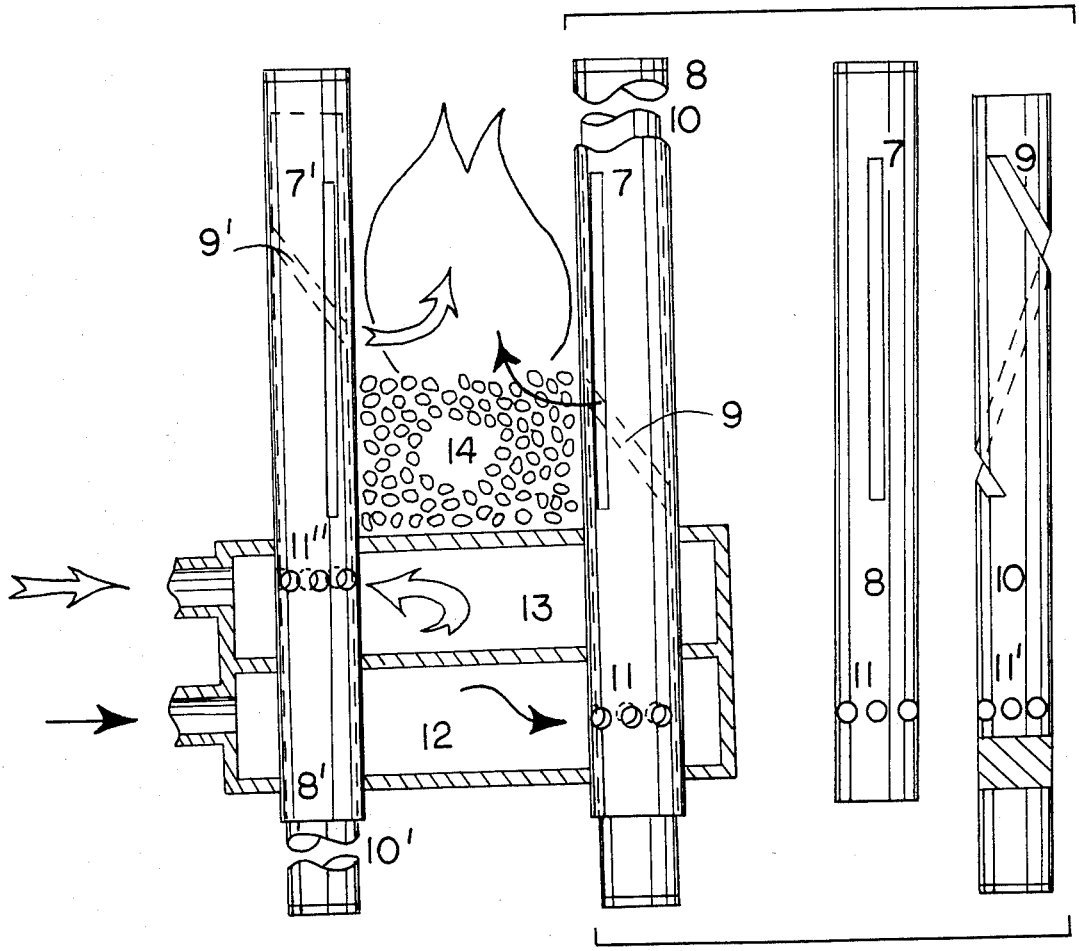

FIG. 2 shows slot 7 parallel to axis of fixed tube 8, and slot 9 in spiral relation to the axis of movable tube 10. Tube 10 is of such a size as to fit snugly inside tube 8. Rotation of tube 10 inside tube 8 changes the location of the intersection of slots 7 and 9. Holes 11 and 11' allow free communication of air from the outside of tube 8 to the inside of tube 10 throughout the range of rotation of tube 10. The top of tube 8 is sealed, and the bottom of tube 10 is sealed. Sealing means is provided to prevent air leakage between tube 8 and tube 10 below holes 11. Grease applied to the cross-hatched area of tube 10, at the right side of FIG. 2, provides adequate sealing means for low pressure use. Supporting means, not shown, is provided to prevent air pressure from forcing tube 10 out of tube 8.

Figure 3:
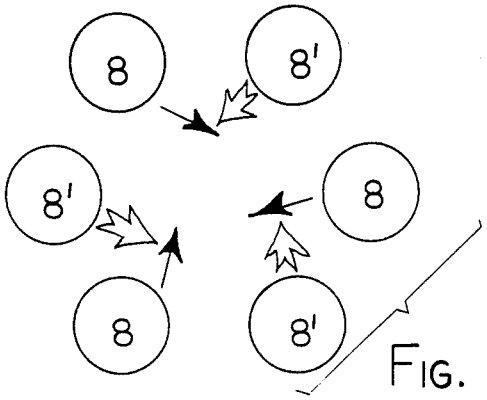
FIGS. 2 and 3 show a variation wherein the fixed and movable surfaces are of tubular construction. This is the preferred embodiment.

Air supplied to plenum 12 passes through holes 11 and 11' to the inside of tube 10, and then out through the intersection of slots 7 and 9 to combustion zone 14. Similarly, air supplied to plenum 13 passes through holes 11'' in tube 8' to the inside of tube 10', and then out through the intersection of slots 7' and 9' to combustion zone 14. In the example shown, plenum 12 supplies primary combustion air, and plenum 13 supplies secondary air. The volume of air supplied to each plenum may be independently varied. Arrows on the figure indicate the flow of air. In FIG. 3, the use of multiple tubular assemblies is illustrated.

Figure 4:
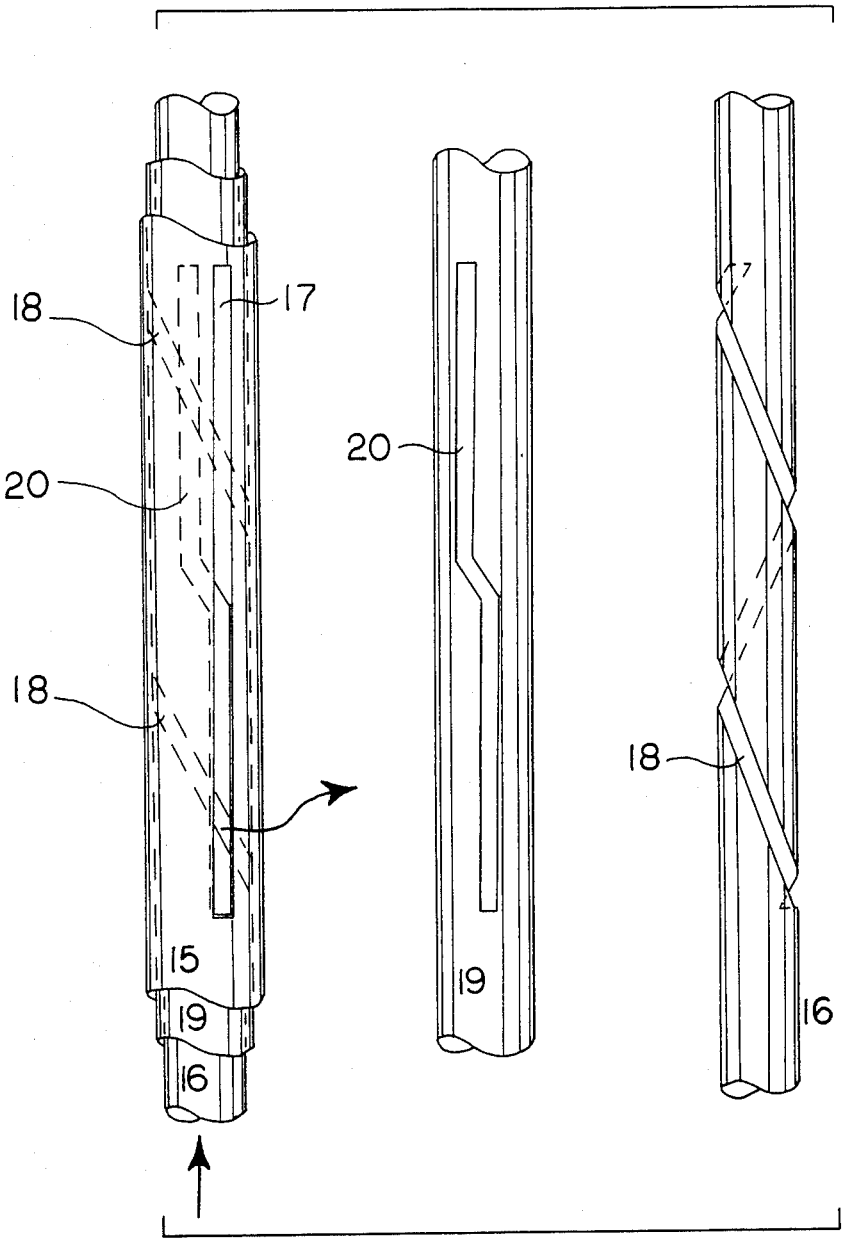
FIG. 4 shows the addition of a second movable surface to extend the range of adjustment.

FIG. 4 shows tubes 15 and 16, corresponding respectively to tubes 8 and 10 of FIG. 2. Slots 17 and 18 correspond respectively to slots 7 and 9; however, slots 17 and 18 are of such a length as to intersect twice, whereas slots 7 and 9 intersect only once. Tube 19, containing offset slot 20, may be interposed between tubes 15 and 16, covering one of the intersections. In the case illustrated, the upper intersection is covered, and air flows through the lower intersection. A simple rotation of tube 19 will cover the lower intersection, and allow air to flow through the upper intersection. Proper manipulation of tubes 16 and 19 will allow the position of the uncovered intersection to be continuously varied over the full length of slot 17. In this construction, tube 16 should fit snugly inside tube 19, which should fit snugly inside tube 15. Tubes 15 and 16 with slots 17 and 18 may be extended to create additional intersections of the slots, and tube 19 with slot 20 may be extended, with additional offsets in slot 20, so that all intersections but one are covered.

Figure 6:
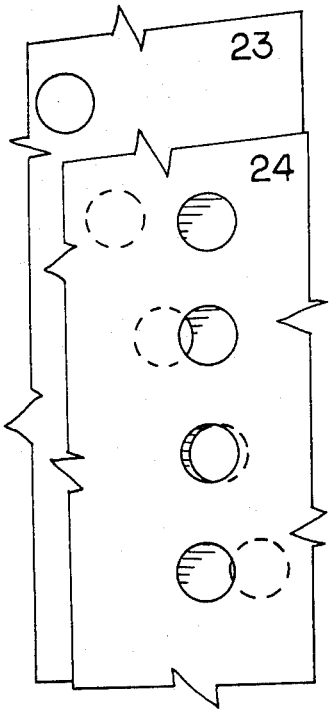
FIGS. 5, 6 and 7 show the use of discrete holes rather than slots in the various surfaces.
Figure 5:
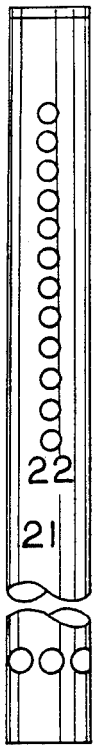
Figure 7:
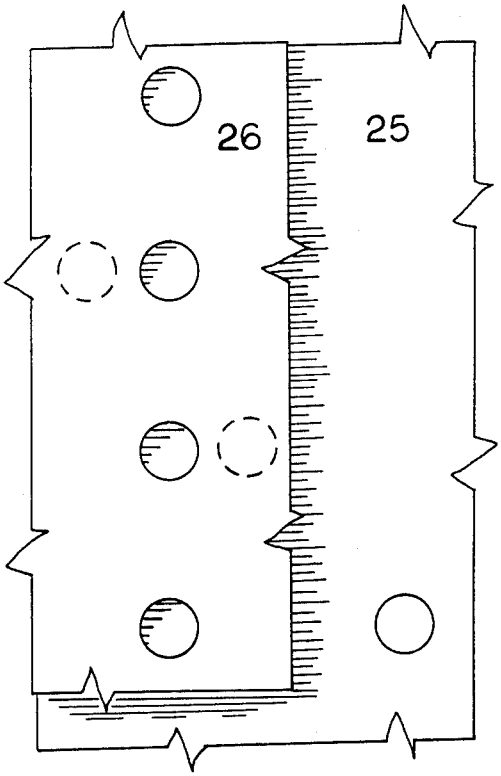

For ease of construction or for other reasons, any slot in the previous discussion may be replaced by a series of discrete holes, as shown in FIG. 5, wherein tube 21 corresponds to tube 8 of FIG. 2, and holes 22 correspond to slot 7. If the holes are spaced closely together, the function of the apparatus is essentially unchanged. The holes in surfaces 23 and 24, shown in FIG. 6, are spaced closely together, so that during transverse movement of surface 23, either two or three pairs of holes will always intersect and provide openings for the passage of air. The holes in surfaces 25 and 26, shown in FIG. 7, are spaced too far apart; transverse movement of surface 25 can close all openings. Maximum allowable spacing of holes in any specific case will depend upon both hole size and angle of intersection of the two hole series, or of a hole series and a slot.

For ease of definition, it is stated that a fixed surface or a movable surface may contain either an aperture, i.e. the slot, or a series of apertures, i.e. the discrete holes.

Figure 1:
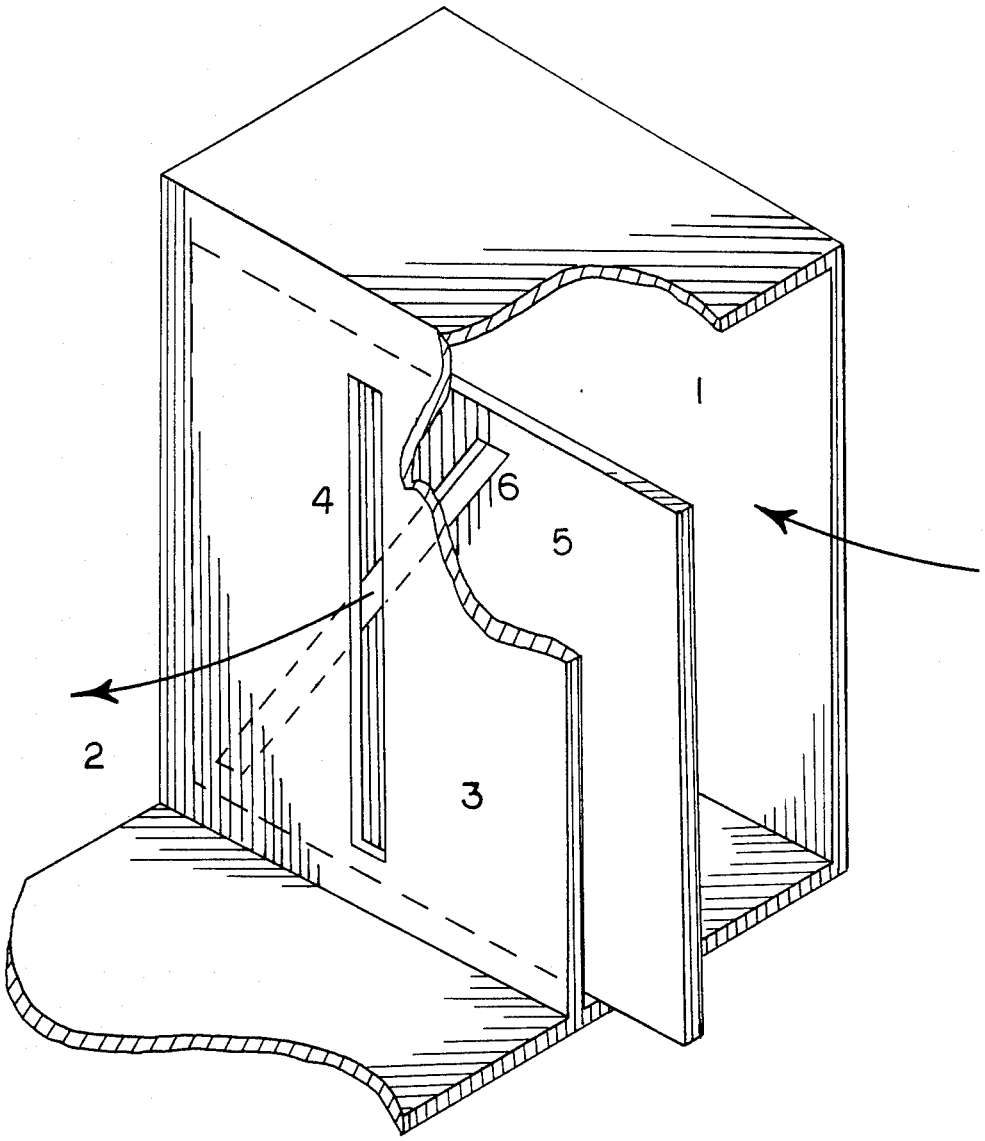
FIG. 1 shows the simplest embodiment of the invention, wherein the fixed and movable surfaces are flat. Air plenum 1 is separated from combustion zone 2 by fixed surface 3 containing slot 4, and by movable surface 5 containing slot 6. Slot 6 is constructed at an angle to slot 4. Air passes from plenum 1 to combustion zone 2 through the intersection of slots 6 and 4. The location of this intersection may be adjusted by transverse movement of surface 5. Arrows on the figure indicate the flow of air.

Although FIGS. 4 and 5 show tubular surfaces, the application to the surfaces of FIG. 1 is obvious. Also, although the previous discussion has referred to fixed and movable surfaces, it should be obvious that the so-called fixed surfaces may also be movable without altering the essential function of the device. For example, the construction of FIG. 2 could be modified to permit rotation of tube 8, for the purpose of varying the horizontal angle at which air enters the combustion zone, without altering the essential fact that the vertical location at which air enters the combustion zone is controlled by rotation of tube 10 relative to tube 8.

For further ease of definition, it is stated that a surface which is said to be movable is understood to be movable with respect to adjacent surfaces. If a surface is not said to be movable, motion of that surface is not required to produce the desired effect on air flow within the apparatus.

I claim:

1. In a combustion apparatus, means for adjustment of an air supply location with respect to a combustion zone, comprising, a first movable surface having a first aperture or series of apertures therein, a second movable surface having a second aperture or series of apertures therein, means for moving said surfaces to adjust the point of intersection of said first and second apertures or series of apertures whereby air may pass through said point of intersection, a third movable surface having a third aperture or series of apertures and arranged with said first and second surfaces to extend the range of adjustment.

2. The apparatus of claim 1, wherein said first, second, and third surfaces are of tubular construction.

* * * * *